United States Patent [19]

Newcomb

[11] 4,248,484

[45] Feb. 3, 1981

[54] PRESSURE VENTING O-RING BEARING SEAL FOR ROCK BITS

[75] Inventor: Alan L. Newcomb, Rancho Palos Verdes, Calif.

[73] Assignee: Smith International, Inc., Newport Beach, Calif.

[21] Appl. No.: 78,370

[22] Filed: Sep. 24, 1979

[51] Int. Cl.[3] ..... F16C 33/74

[52] U.S. Cl. ..... 308/8.2; 308/36.1

[58] Field of Search ..... 308/8.2, 36.1, 36.3, 308/187.1, 187, 36.2; 277/3; 175/371, 372

[56] References Cited

U.S. PATENT DOCUMENTS

| | | | |
|---|---|---|---|
| 3,476,195 | 11/1969 | Galle | 175/228 |
| 3,735,825 | 5/1973 | Keller | 175/372 |
| 4,194,795 | 3/1980 | Rife | 308/36.1 |
| 4,199,156 | 4/1980 | Oldham et al. | 308/8.2 |

*Primary Examiner*—Lenard A. Footland

*Attorney, Agent, or Firm*—Robert G. Upton

[57] ABSTRACT

In conventional rock bits which utilize a lubrication system, a pressure venting function for a radial type O-ring bearing seal is accomplished by allowing the excessive lubricant pressure buildup within the rock bit to bulge the O-ring into a venting pocket or cavity located in the seal gland boss thus breaking the sealing contact and venting the excess pressure without significant loss or further contamination of the bearing lubricant with harmful fluids and abrasives.

11 Claims, 4 Drawing Figures

PRESSURE VENTING O-RING BEARING SEAL FOR ROCK BITS

BACKGROUND OF THE INVENTION

1. Field of the Invention

This invention relates to self-lubricated rock bits.

More particularly, this invention relates to a self-lubricated rock bit with a means to relieve an overpressure condition within the rock bit with negligible loss of lubricant.

2. Description of the Prior Art

There are several patents that deal with a lubricant relief valve for rock bits. Most representative of these patents is U.S. Pat. No. 3,476,195 which discloses a relief valve to relieve overpressure conditions within a bit. This invention resulted from the drilling of deep wells with lubricated rock bits equipped with lubricant seals and also provided with flexible pressure compensators and vent holes to equalize the pressure between the lubricant within the bearing and the drilling fluid or mud surrounding the bit. Excessive pressure or heat buildup within the bits caused the pressure within the bit to exceed the drilling fluid pressure. This internal overpressure condition caused the flexible compensator to be extruded into a vent hole which often resulted in the destruction of the compensator and hence, loss of lubricant which extrudes from the drilling bit into the borehole.

It has been determined that the basic cause of the trouble is a pressure buildup within the bit brought about by cracking and thermal expansion of the lubricant. In deep borehole wells the bit is often subjected to very high pressures and temperatures, particularly in the vicinity of the journal bearings.

This invention relieves this overpressure condition by providing a valve, similar to a conventional pneumatic tire valve, that serves to relieve the pressure adjacent the compensator before it can rupture the compensator. These one-way valves are low pressure in nature and permit outflow from the lubricant chamber to the outside of the bit while blocking any reverse flow of contaminating fluids through the valve.

This invention is disadvantaged in that the low pressure relief valve is physically located adjacent the compensator diaphragm some distance away from the journal bearing of the rock bit. Since the excessive heat which causes the cracking of the lubricant and the high pressure condition is generated on the bearing surfaces between the journal and the cone associated therewith, there is danger of journal bearing seal failure. The seal is located between the cone and the journal bearing and the pressure buildup is immediately adjacent the seal. Hence, locating the overpressure valve some distance away from the initiation of this high pressure source increases the likelihood of seal failure due to the overpressure condition, displacement of the lubricant from the bearing and further contamination of the lubrication system.

The present invention provides a means to relieve the gases resultant from the cracked lubricant within the journal bearing at the source. In other words, a cavity is provided adjacent the O-ring seal so that excessive pressure within the bearing forces the O-ring locally out of the seal gland and into the cavity, thereby relieving the source of pressure past the seal that is displaced within the relatively small cavity in the seal gland boss or flange surface. Therefore, excessive pressure is relieved at the source of the problem in the rock bit.

Relieving the pressure adjacent the journal bearing through a displaced O-ring seal prevents further contamination of the lubrication system with gases and debris.

SUMMARY OF THE INVENTION

An object of this invention is to relieve excessive gaseous pressures resultant from cracked lubricants within a rock bit adjacent the journal bearing, where the greatest heat is generated, to immediately relieve the overpressure condition past an elastomeric seal element or O-ring before the rock bit lubricant becomes contaminated upstream in the reservoir.

More particularly, it is an object of this invention to provide a groove-like cavity or vent pocket, which is positioned on the side of the O-ring seal gland boss away from the bearing load between the journal bearing and a rotary cutter, to vent high gaseous pressure adjacent the lubricant cracking bearing surface to prevent contamination of the lubricant and minimize lubricant displacement from the bearing.

The pressure relieving cavity of the present invention consists of a pocket-type depression formed in the annular seal gland boss formed between the journal and the cutter cone. The cavity occupies only a small segment of the annular O-ring seal gland boss. High pressure resulting from the cracking of the bearing lubricant is generated between the journal bearing and the roller cutter. When the pressure builds up to a sufficient level to locally deflect or bulge the resilient O-ring from the seal gland into the cavity, the peripheral line of sealing contact is broken and the excess gaseous pressure is allowed to escape by the deflected O-ring. The elastomeric O-ring subsequently returns to its original shape, assisted by rotary motion and guidance by the vent pocket and flange surfaces, and again will maintain a sealing engagement within the O-ring's seal gland upon release of the excess pressure.

The cavity is preferably positioned in the seal gland boss of the backface of the leg of the journal bearing rock bit so that the O-ring deflects in an approximately axial direction relative to the axis of the journal bearing, thus breaking the peripheral sealing contact and allowing the excess pressure to escape by the seal. The cavity positioned on the side of the leg backface away from the bearing load can be short in length, thus requiring a higher pressure to deflect the resilient O-ring into the cavity; or the cavity may be elongated in a path comparable to the annular curvature of the seal gland, thus requiring less pressure to break the seal and allow the excess pressure to escape.

In addition, the annular groove or vent pocket may have the bottom of the cavity continued through the flange surface structure by a passage that provides positive venting to the external environment or radially extending spurs communicating with the main cavity, providing adequate bypass clearance to allow the excess pressure to bleed through the bypass spur or vent passage toward the outside of the rock bit.

An advantage then over the prior art is the ability to relieve the gaseous high pressure in the vicinity of the bearing surfaces so that gas is bled off to a safe level without further contamination of the rock bit lubricant.

Another advantage is that the seal life will be extended by protection from overpressure extrusion wear and damage.

Still another advantage over the prior art is the relative simplicity of the invention. A simple cavity is provided to permit a portion of the O-ring to locally deflect from the seal gland and bulge into the cavity to break the peripheral sealing contact and allow high pressure to escape thereby. Prior art devices have shown all types of complicated valves and venting systems to relieve high pressures within the bit. This pressure venting seal can be easily incorporated into the multiple sealed bearing rolling cutters of big hole industrial rock bits as well as the sealed bearing rolling cutter rock bits typically used in the oil fields.

The above noted objects and advantages of the present invention will be more fully understood upon a study of the following description in conjunction with the detailed drawings.

DESCRIPTION OF THE PREFERRED EMBODIMENTS AND BEST MODE FOR CARRYING OUT THE INVENTION

Figure 1:
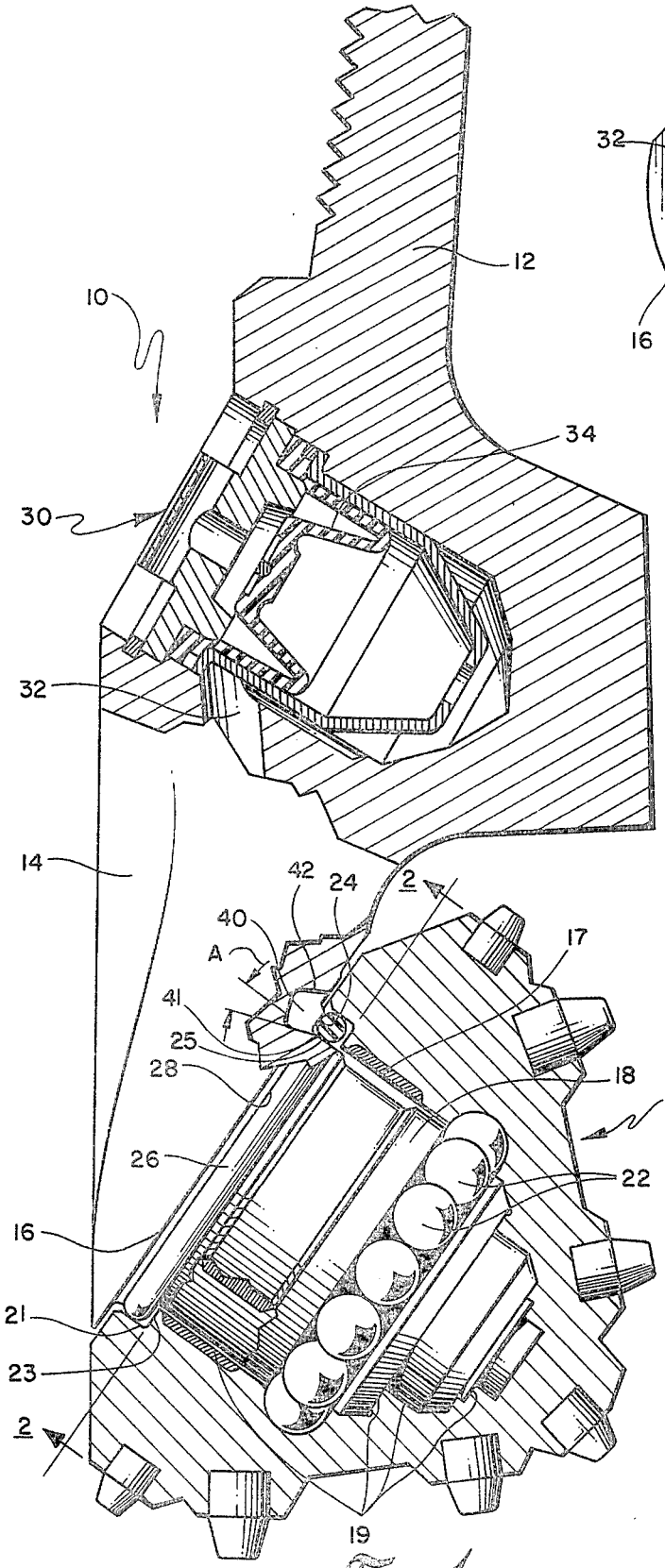
FIG. 1 is a partially broken-away cross section of one segment of a multi-cone rock bit illustrating the lubricant system, the journal bearing, and the cutter cone rotatably mounted to the journal bearing with the attendant O-ring sealing system therein.

With reference to FIG. 1, the rock bit, generally designated as 10, comprises an upper pin portion 12, leg portion 14, and journal backface structure 16. Cantilevered from the backface structure 16 is a friction bearing journal 18 with a tungsten carbide insert rolling cutter 20 rotatably secured to the journal by a series of rolling bearing retainer balls 22.

An annular rotary seal gland 24 is formed in cooperative relationship by a seal race bore 21 and a flange surface 23, which are recessed into an open end of the bearing cavity 17 in the cutter 20, and a seal race land 25 and a seal boss flange surface 28 which are formed in the journal 18 where the journal abuts the backface structure 16.

A ring-shaped elastomeric seal or O-ring 26 is contained in gland 24 with peripheral sealing contact between the seal race bore 21 and the seal race land 25 and with retention and lateral guidance for seal 26 provided by the flange surface 23 in the cutter 20 and the flange surface 28 in the backface structure 16.

Since the rock bit 10 is self-lubricated, a pressure compensating accumulator system, generally designated as 30, supplies lubricant down channel 32 to the bearing surfaces 19 between the journal 18 and the cutter 20.

A pressure relieving cavity, or vent pocket, generally designated as 40, is positioned within the seal boss flange surface 28 in the backface structure 16. As stated before, the vent pocket 40 serves to allow the O-ring 26 to deform locally and deflect within the interior portion of the vent pocket 40 to break the sealing contact in gland 24 and allow the overpressure condition to pass by the deflected O-ring and escape to the exterior of the rock bit. When vent pocket 40 is formed with a declension, as shown by angle A, to the seal race land 25 of journal 18, their surface intersection forms a land-pocket breakline 41 which controls the venting location on the seal race land 25.

Figure 2:
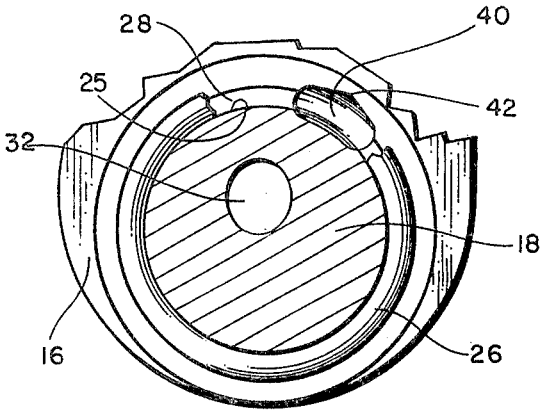
FIG. 2 is a partial section taken through 2—2 of FIG. 1 illustrating the pressure relieving vent cavity in the journal backface of the rock bit.

FIG. 2 illustrates the general shape of the preferred embodiment wherein the vent pocket 40 is a cavity which is typically symmetric in shape following the annular curvature of the O-ring, the width of the pocket being generally slightly larger than the cross section of the O-ring and the effective length of the pocket being determined by the amount of the overpressure condition to be tolerated before the overpressure condition is vented to the exterior of the bit 10. The radially extending bypass channel 42 is so positioned to allow the escaping high pressure gases to vent from the interior of the cavity 40.

The vent cavity 40 is preferably positioned in seal boss 28 adjacent the side away from the loaded bearing surfaces 19 (FIG. 1) to further protect the cavity from blockage by the packing of sticky shale, clay, debris and the like.

A typical self-lubricated rock bit such as a $7\frac{7}{8}$ F4 tungsten carbide insert bit, manufactured by Smith Tool, assignee of the present invention, has a journal bearing diameter of 2.117 inches. This bit utilizes, for example, a resilient nitrile elastomer O-ring seal between the journal and the cutter with an inside diameter of 2.130 inches. The O-ring in the above example has a cross section of 0.213 inch. The vent pocket 40, in seal boss 28, is 0.295 inch in depth, 0.59 inch in length and 0.234 inch in width. The pocket as described will relieve an overpressure condition within the rock bit, using an O-ring of the above description, when the pressure differential is between 50 and 300 pounds per square inch.

Figure 3:
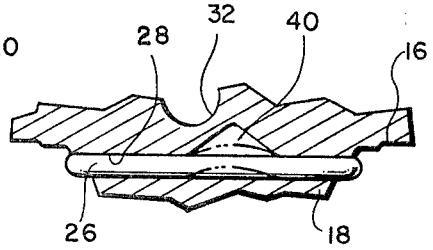
FIG. 3 is a view 90° relative to FIG. 2 illustrating the depth and general shape of the cavity and the resilient O-ring deflecting into the cavity under a high pressure condition.

FIG. 3 clearly shows the depth and contour of the vent pocket 40 which allows the O-ring to deflect (shown in phantom line) within the pocket. Obviously, the longer the pocket the easier the resilient O-ring deflects within the pocket to vent the pressure. The angular slope of the pocket contour presented to the seal 26 should be less than 50 degrees relative to the seal boss flange surface 28 to prevent buckling and damage by friction to the seal. Loss of lubricant could occur with a large vent pocket thus causing short bit runs within a borehole due to premature bearing failure. The length of the pocket, which can typically range between 1.3 to 4.7 times the section thickness of the seal 26, is determined by the amount of overpressure allowed and the temperature of the lubricant at which this condition is to be relieved.

Figure 4:
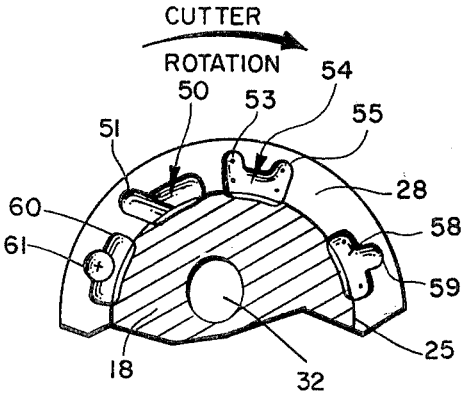
FIG. 4 is a partially cut-away cross section illustrating various cavity configurations for an internally lubricated rock bit.

Turning now to FIG. 4, several cavity configurations are shown (50, 54, 58 and 60), each configuration of which provides a different path for the excess gaseous pressure to be vented from the interior of the rock bit. Cavity 50 illustrates a venting path for the high pressure gas which follows an oblique angle relative to the track of the O-ring to provide improved seal return guidance in the direction of cutter rotation. The cavity, configured as 54, illustrates a blockage resistant double vent path 53 and 55 which could easily be milled into the seal boss 28 of the backface structure 16. The cavity, as shown in configuration 58, has a single, centrally positioned spur point 59 which leads overpressure gases through the shortest radially outwardly extending channel from cavity 58. The cavity depicted by 60 has a positive venting passage 61 continued from the flange surface 28 of the cavity through the backface structure 16 to the outside of the bit to avoid blockage by the cutter 20 closing against the backface 16.

It will of course be realized that various modifications can be made in the design and operation of the present invention without departing from the spirit thereof. Thus, while the principal preferred construction and mode of operation of the invention have been explained in what is now considered to represent its best embodiments which have been illustrated and described, it should be understood that within the scope of the appended claims the invention may be practiced otherwise than as specifically illustrated and described.

I claim:

1. A pressure venting rotary seal for use in sealed bearing rolling cutter rock bits to retain lubricant in a bearing cavity and to exclude harmful fluids and abrasives of the type that utilizes a ring-shaped elastomeric seal contained with peripheral sealing contact, in an annular rotary seal gland formed between a rolling cutter and a bearing surface of a journal, the improvement which comprises:

a seal race bore and a flange surface formed in said cutter, said bore being recessed into an open end of said bearing cavity in said cutter;

a seal race land and flange surface formed in said journal, said seal race bore and seal race land being adjacent one another in cooperating relationship forming said annular rotary seal gland when said cutter is rotatably mounted on said journal; and said flange surface formed in said cutter that is in communication with said bearing cavity contains a venting pocket formed in said flange surface, said vent pocket being of suitable size and shape to permit excessive internal pressure within said rolling cutter rock bit to deflect a portion of the elastomeric seal to locally exit the annular rotary seal gland and break sealing contact thus venting said excess pressure from the bearing cavity, said seal elastically returns to a sealing position upon venting of said excess pressure.

2. The invention as set forth in claim 1 wherein the length of said vent pocket, relative to the annular seal gland ranges between 1.3 and 4.7 times the cross section thickness of the elastomeric seal, determines the threshold of venting overpressure buildup in the bearing cavity; the longer the vent pocket the lower the vent pressure, the shorter the cavity the more the elastomeric seal will resist deflection and require a higher pressure within the rock bit to vent.

3. The invention as set forth in claim 2 wherein the width of the vent pocket is larger than the cross section thickness of the seal to provide adequate bypass clearance for venting pressure within said rock bit.

4. The invention as set forth in claim 3 wherein the depth of the vent pocket will allow the seal sufficient deflection to exit the seal gland and break the peripheral sealing contact at an outer edge of said seal race bore in said cutter.

5. The invention as set forth in claim 4 wherein said vent pocket is angled with respect to said flange surface such that said vent pocket slopes toward an axis of said journal to discourage entrapment of said seal within said vent pocket.

6. The invention as set forth in claim 5 wherein the vent pocket is formed with sufficient depth into the flange surface and with a declension into a portion of the seal race land on the journal to permit deflection of the elastomeric seal such that breaking the peripheral sealing contact on the seal race land is controlled by the axial location of the intersection of said sloped vent pocket surface with the seal race land.

7. The invention as set forth in claim 6 wherein the elastomeric seal has a normally circular cross section.

8. The invention as set forth in claim 7 wherein the vent pocket shape conforms substantially to the curvature of said elastomeric seal.

9. The invention as set forth in claim 8 wherein the vent pocket is symmetrically shaped with respect to a radial centerline and the bottom of the vent pocket is contoured so as to present an angular slope to the seal less than fifty degrees relative to said flange surface.

10. The invention as set forth in claim 9 wherein said bottom of said vent pocket is continued through from the flange surface by a passage formed in said rock bit that provides positive venting to the exterior of said rock bit.

11. A process to relieve the high gaseous pressure buildup within a sealed bearing rolling cutter rock bit of the type that utilizes a resilient O-ring as a lubricant seal between the journal and a cutter comprising the steps of:

forming a vent pocket in a flange surface of a seal gland formed by a journal structure and said cutter, and pressing a portion of the resilient O-ring from the seal gland into said vent pocket when said high gaseous pressure forces the O-ring into said vent pocket, said high pressure vents past the deformed O-ring, the O-ring returns to its original shape after the excess gaseous pressure is relieved, thus reestablishing a sealing engagement within said seal gland.

* * * * *